US009198473B2

(12) United States Patent
Thompson

(10) Patent No.: US 9,198,473 B2
(45) Date of Patent: Dec. 1, 2015

(54) MITT

(71) Applicant: Marilyn Thompson, Victoria (CA)

(72) Inventor: Marilyn Thompson, Victoria (CA)

( * ) Notice: Subject to any disclaimer, the term of this patent is extended or adjusted under 35 U.S.C. 154(b) by 0 days.

(21) Appl. No.: 14/578,591

(22) Filed: Dec. 22, 2014

(65) Prior Publication Data

US 2015/0173437 A1 Jun. 25, 2015

Related U.S. Application Data

(60) Provisional application No. 61/920,016, filed on Dec. 23, 2013.

(51) Int. Cl.

| | |
|---|---|
| ***A41D 19/01*** | (2006.01) |
| ***A41D 13/08*** | (2006.01) |
| ***A63B 57/00*** | (2015.01) |
| ***A63B 71/14*** | (2006.01) |

(52) U.S. Cl.

CPC ..... *A41D 19/01* (2013.01); *A41D 13/085* (2013.01); *A63B 57/00* (2013.01); *A63B 71/14* (2013.01); *A63B 71/146* (2013.01); *A63B 2209/10* (2013.01)

(58) Field of Classification Search

CPC ..... A41D 19/01; A41D 19/00; A41D 19/002; A41D 13/085; A41D 13/08; A63B 71/146

USPC ..... 2/158, 159, 160, 161.2, 161.5, 17, 910

See application file for complete search history.

(56) References Cited

U.S. PATENT DOCUMENTS

| | | | | |
|---|---|---|---|---|
| 571,020 | A * | 11/1896 | Royce | A41D 13/085 2/17 |
| 2,089,086 | A * | 8/1937 | Farkas | 2/17 |
| D188,035 | S | 5/1960 | MacKay et al. | |
| 2,937,377 | A | 5/1960 | MacKay et al. | |
| 2,937,378 | A | 5/1960 | MacKay et al. | |
| 5,083,314 | A | 1/1992 | Andujar | |
| 5,577,607 | A | 11/1996 | Drake et al. | |
| 5,740,700 | A * | 4/1998 | Redmond | 74/551.8 |
| 5,862,916 | A | 1/1999 | Utecht | |
| 7,117,536 | B2 * | 10/2006 | Burnett et al. | 2/16 |

(Continued)

OTHER PUBLICATIONS

Oven mitt, available Sep. 18, 2013, [online], [site visited Mar. 10, 2015]. Available from internet, <URL: http://www.webstaurantstore.com/san-jamar-810pm15-15-best-grip-oven-mitt-puppet-style/167810PM15.html.

(Continued)

*Primary Examiner* — Tejash Patel

(74) *Attorney, Agent, or Firm* — Davis & Bujold, P.L.L.C.; Michael J. Bujold

(57) ABSTRACT

A mitt consists of a hollow flexible body having an interior, an exterior, a sleeve portion and a grip portion positioned at a remote end of the sleeve portion. The interior of the grip portion is accessible by extending ones hand through the sleeve portion. The grip portion has an external profile that is oriented transversely relative to the sleeve portion. This external profile defines two extremities which are movable between an open position, in which the extremities are spaced apart to define an elongated "C" channel and a closed position in which the extremities are brought together to define an elongated tubular channel. Fasteners are provided on the grip portion to selectively maintain the grip portion in the closed position, whereby the grip portion may be closed around a tubular bar.

3 Claims, 8 Drawing Sheets

(56) References Cited

U.S. PATENT DOCUMENTS

| | | | | |
|---|---|---|---|---|
| D609,137 | S * | 2/2010 | Graham | D12/114 |
| 8,776,267 | B2 * | 7/2014 | Narboni-Campora | 2/158 |
| 2009/0019617 | A1 | 1/2009 | Dillenschneider | |
| 2012/0260447 | A1 | 10/2012 | Klingbeil | |

OTHER PUBLICATIONS

Solid oven mitt, available Sep. 5, 2011, [online], [site visited Mar. 10, 2015]. Available from internet, <URL: http://www.bedbathandbeyond.com/1/1/28518-kitchensmart-solid-oven-mitt.html.

Oven mitt, available Jun. 8, 2012, [online], [site visited Mar. 10, 2015]. Available from internet, <URL: http://www.zesco.com/Browne-Halco-5434202-Oven-Mitt-pz103B064.htm.

Golf trolley mitt, available Mar. 10, 2012, [online], [site visited Mar. 10, 2015]. Available from internet, <URL: http://www.golf-locker.co.uk/product_catalogue/trolacc/.

Clicgear Mitt, [site visited Mar. 10, 2015]. Available from Internet, <URL: http://www.clicgear.com/accessories/mitt.php.

* cited by examiner

MITT

FIELD

There is described a mitt that was developed for use with golf carts, but may be used with infant strollers and in other applications in which a tubular bar is gripped.

BACKGROUND

A standard manual golf cart that is used to transport golf clubs around a golf course, has a tubular bar with a hand grip that is manually gripped in order to push or pull the golf cart. Infant strollers, especially the ones used by joggers, similarly have a tubular bar with a hand grip that is manually gripped in order to push or pull the stroller. In cold weather a person's hands can get cold manually gripping the hand grip of a golf cart or an infant stroller. The mitt that will hereinafter be described was developed to address this problem.

SUMMARY

There is provided a mitt which consists of a hollow flexible body having an interior, an exterior, a sleeve portion and a grip portion positioned at a remote end of the sleeve portion. The interior of the grip portion is accessible by extending ones hand through the sleeve portion. The grip portion has an external profile that is oriented transversely relative to the sleeve portion. This external profile defines two extremities which are movable between an open position, in which the extremities are spaced apart to define an elongated "C" channel and a closed position in which the extremities are brought together to define an elongated tubular channel. Fasteners are provided on the grip portion to selectively maintain the grip portion in the closed position, whereby the grip portion may be closed around a tubular bar.

When the external profile is in the open position, the grip portion of the mitt is placed over a tubular bar with a hand grip. The external profile is then moved to the closed position and the fasteners used to maintain the external profile in the closed position. When the wearer removes his or her hands from the mitt to take a golf shot or check on an infant in the infant stroller, the grip portion remains in the closed portion closed around the tubular bar. This is very convenient as it leaves the mitt suspended from the tubular bar ready for use when the user's task is completed.

If the hand grip has a tubular bar that is supported at either end, there is no concern about the grip portion of the mitt sliding off one end of the hand grip. However, if the tubular bar is supported at only one end, as is the case with some brands of golf cart, something more is required to keep the grip portion of the mitt from sliding off. In such applications, an anchor strap may be provided with a fixed end and a detachable end. The fixed end is secured to the body at a fixed location and the detachable end is detachably secured to the body at a location that is spaced from the fixed location. The anchor strap wraps around the vertical support to which the tubular bar is attached to prevent the grip portion of the body from sliding relative a longitudinal axis of the tubular bar.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
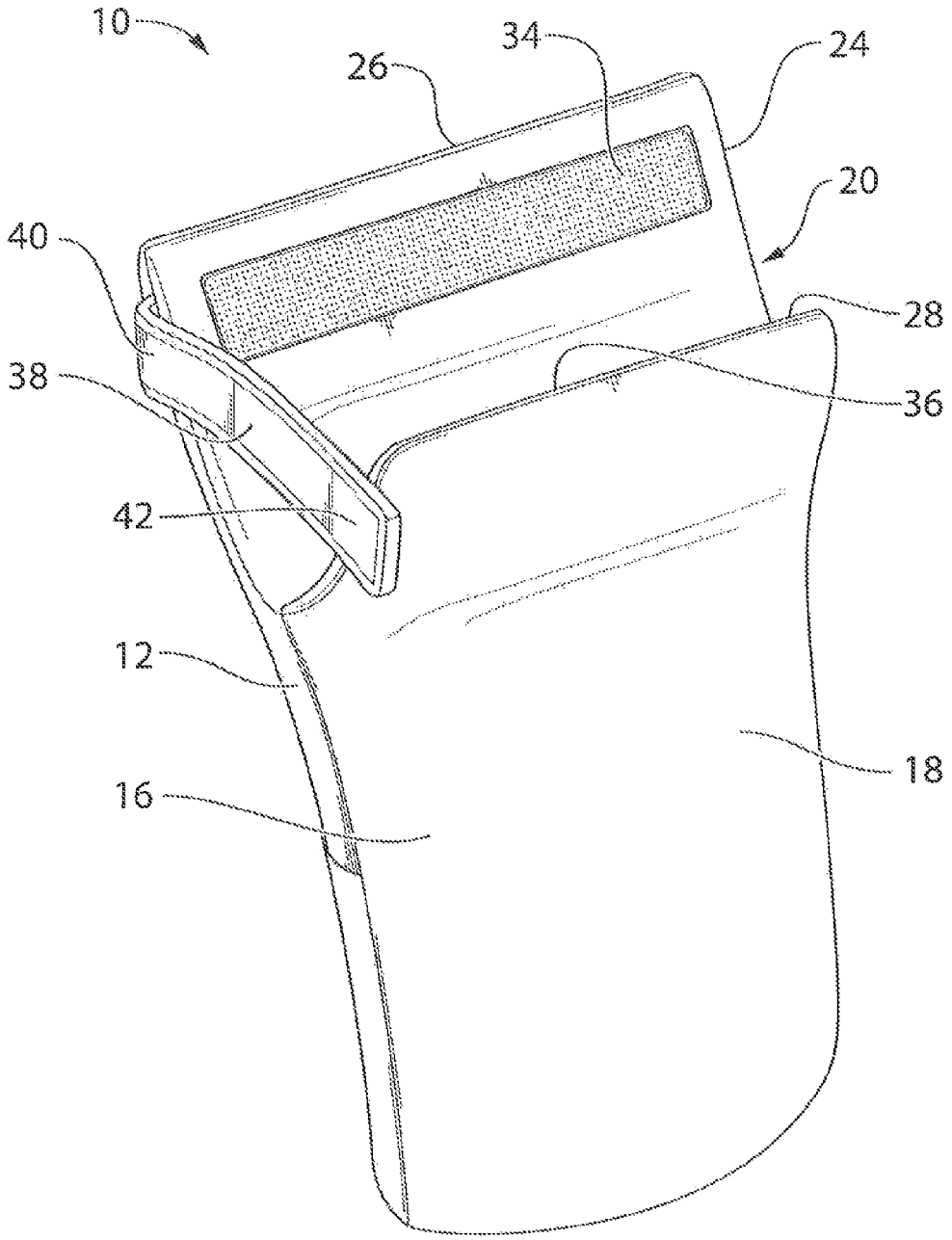
FIG. 1 is a perspective view of a mitt.
Figure 2:
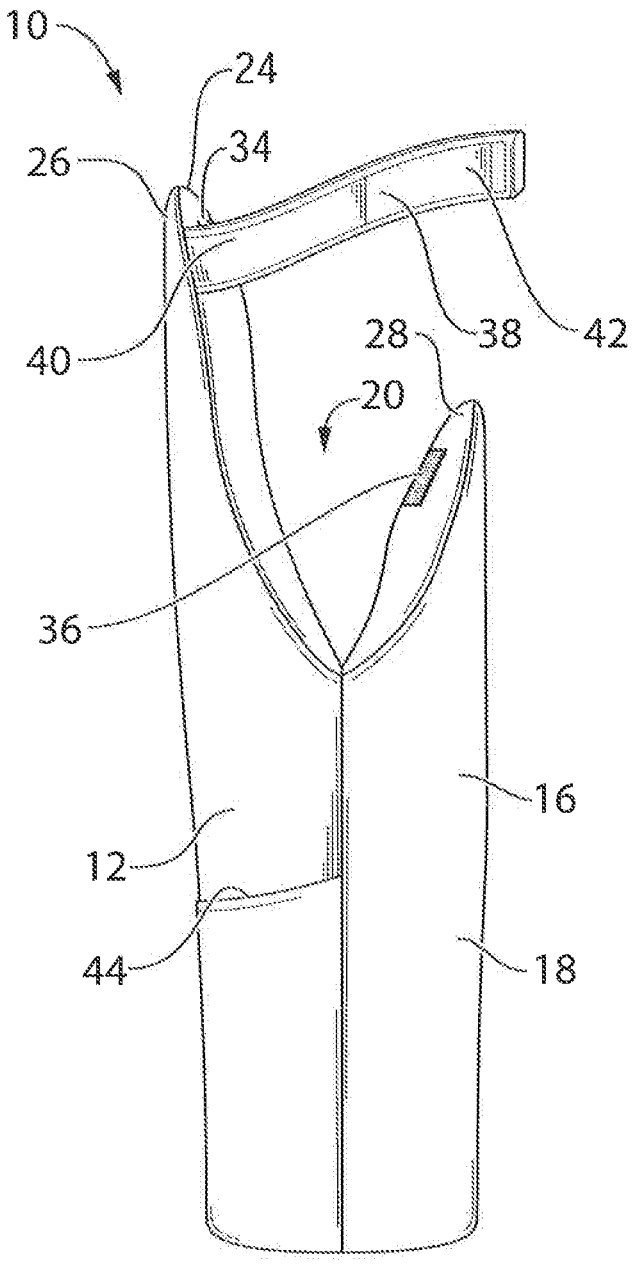
FIG. 2 is a left side elevation view of the mitt illustrated in FIG. 1.
Figure 3:
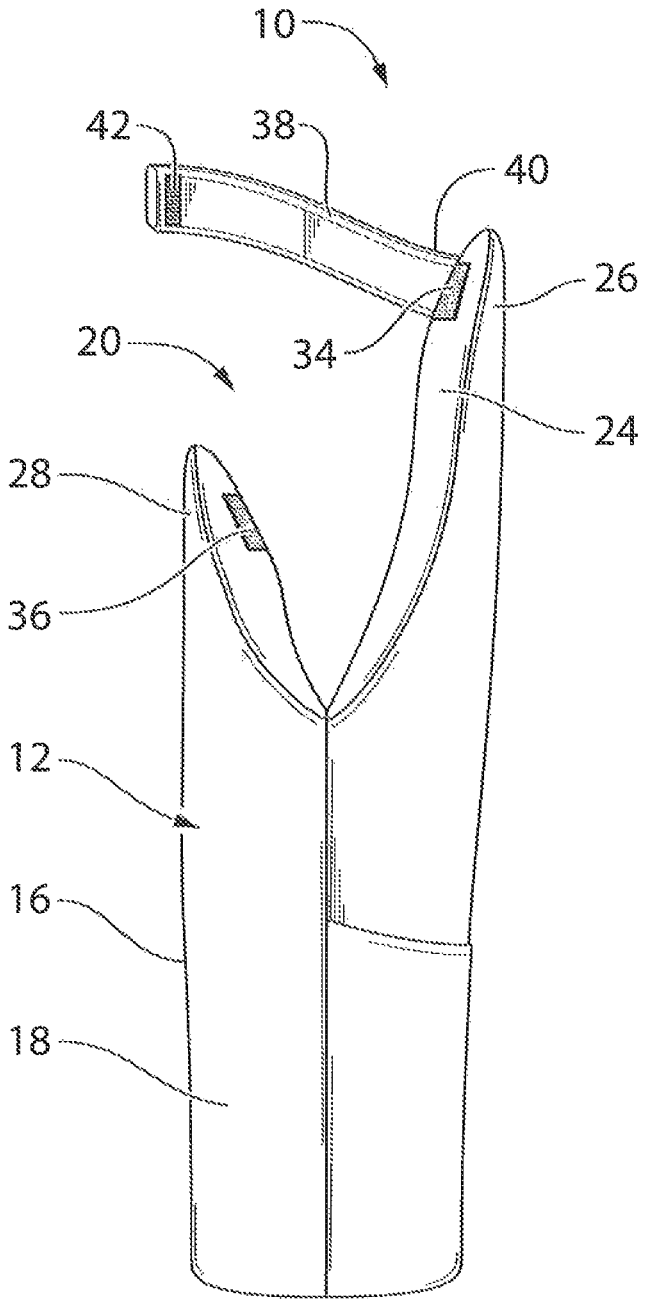
FIG. 3 is a right side elevation view of the mitt illustrated in FIG. 1.
Figure 4:
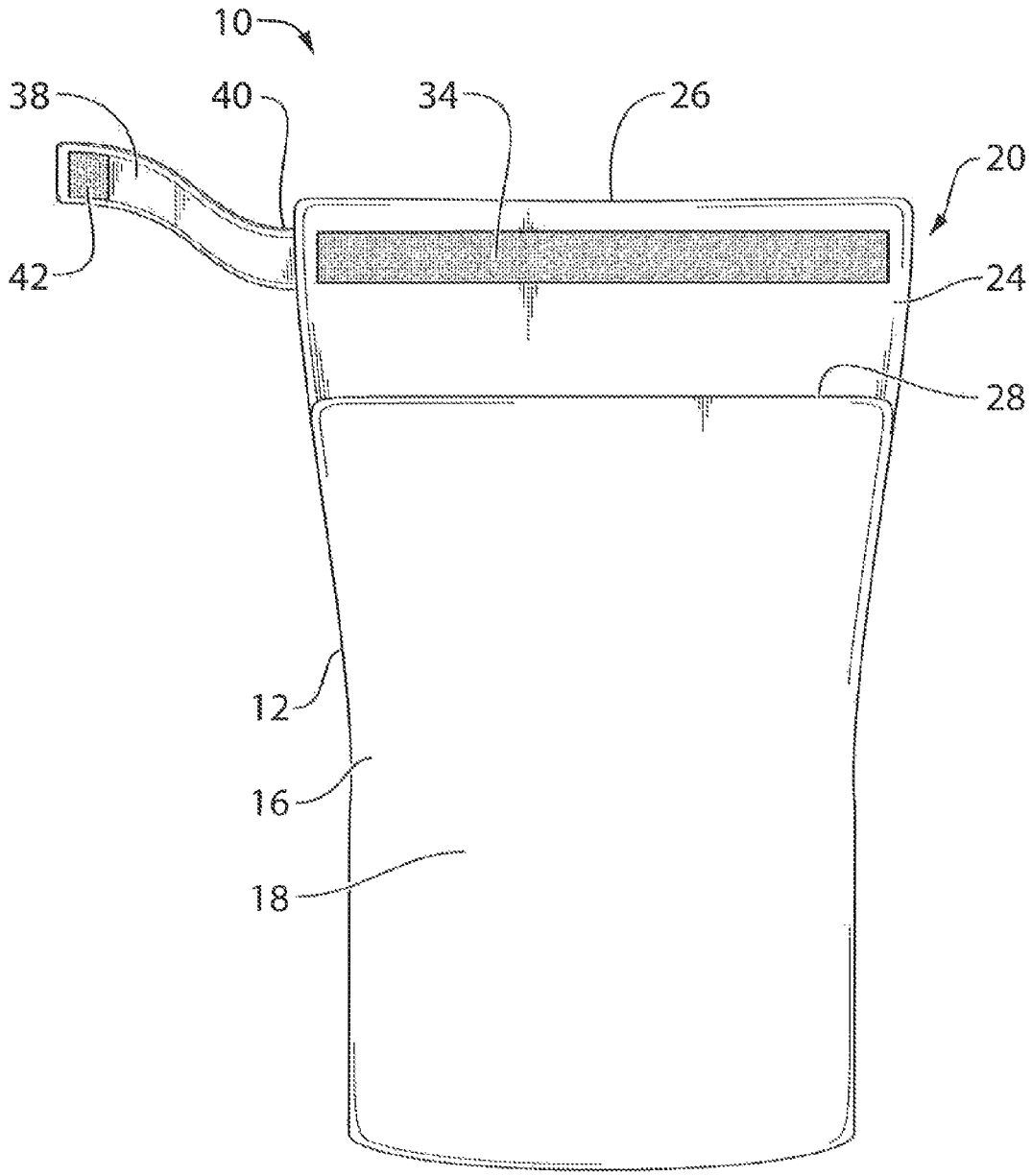
FIG. 4 is a front elevation view of the mitt illustrated in FIG. 1.
Figure 5:
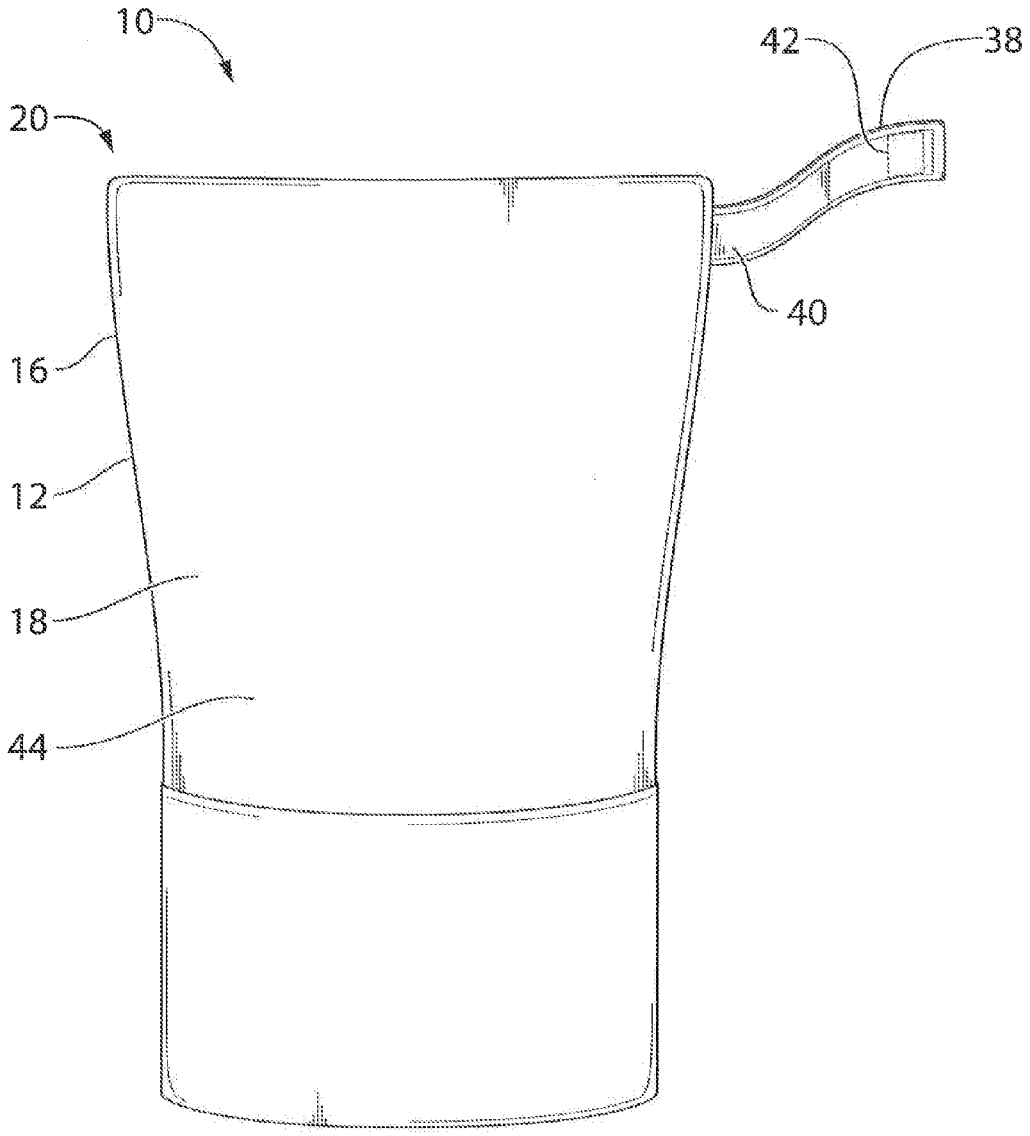
FIG. 5 is a rear elevation view of the mitt illustrated in FIG. 1.
Figure 6:
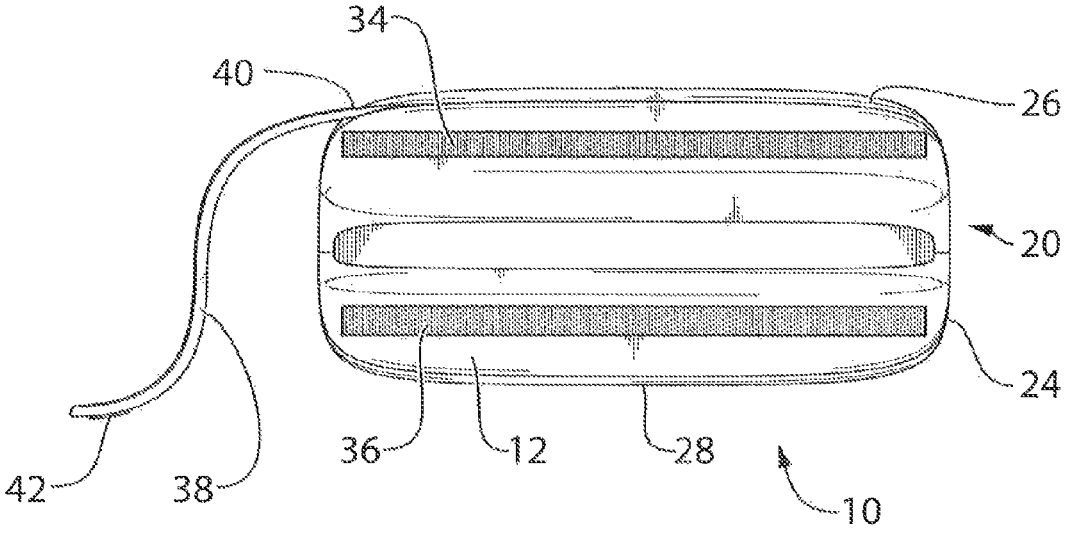
FIG. 6 is a top plan view of the mitt illustrated in FIG. 1.
Figure 7:
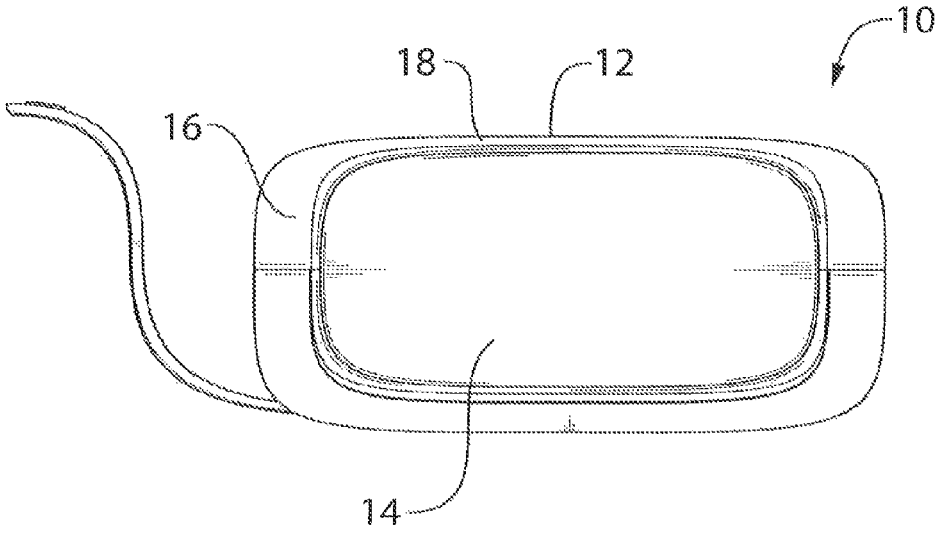
FIG. 7 is a bottom plan view of the mitt illustrated in FIG. 1.

A mitt generally identified by reference numeral 10, will now be described with reference to FIG. 1 through FIG. 9.

Structure and Relationship of Parts

Figure 8:
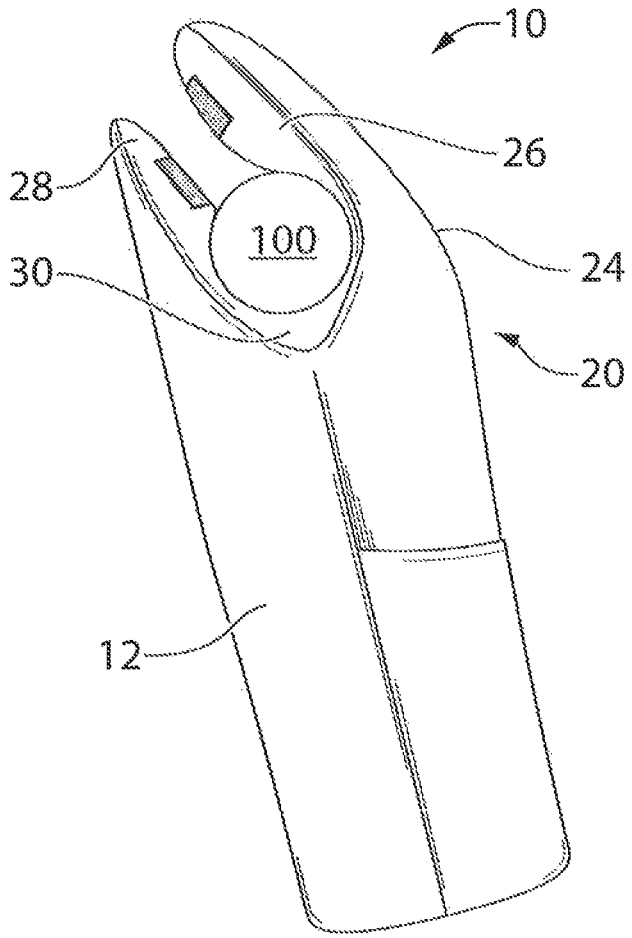
FIG. 8 is a perspective view of the mitt illustrated in FIG. 1, with external profile of grip portion in an open position.
Figure 9:
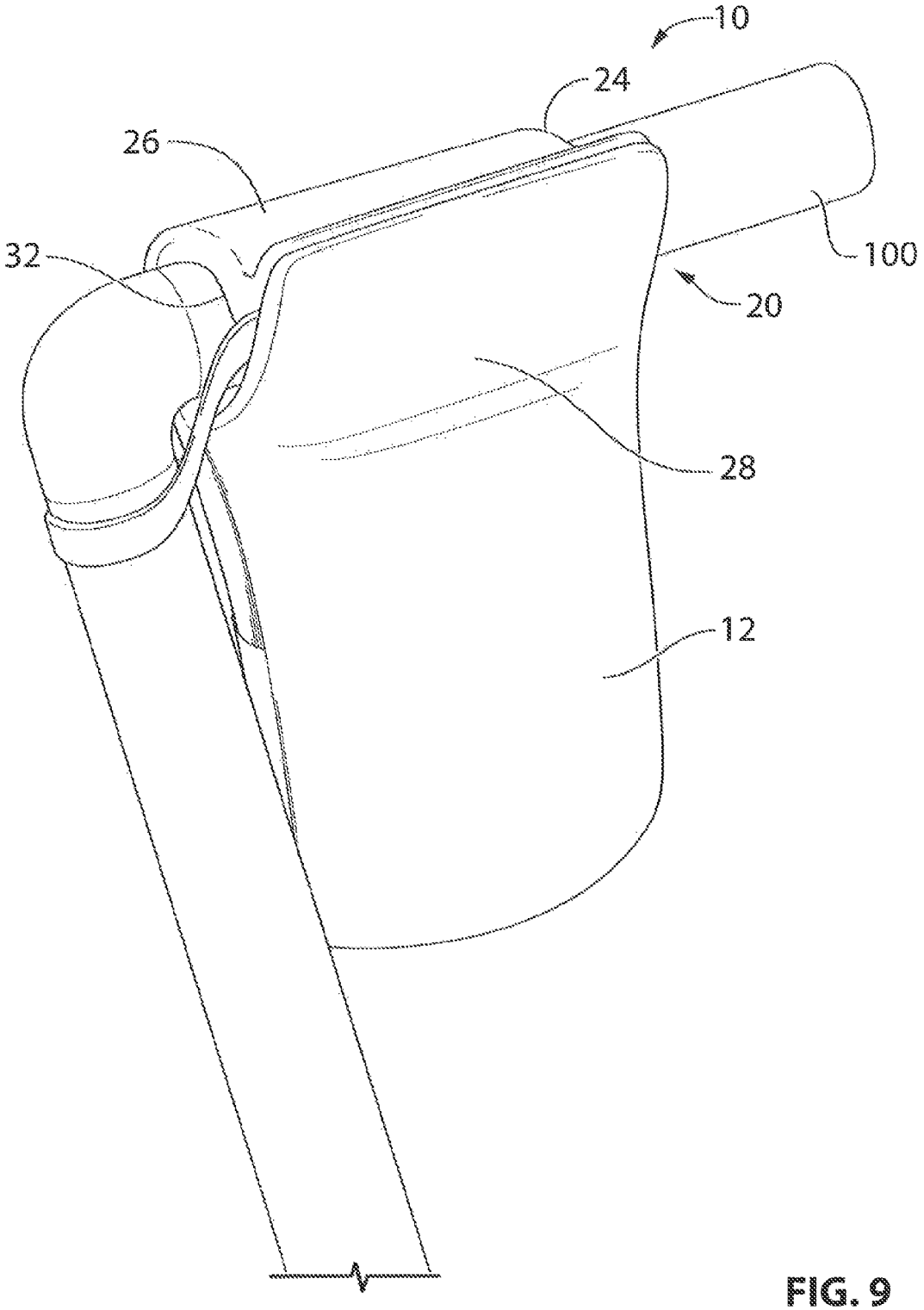
FIG. 9 is a perspective view of the mitt illustrated in FIG. 1, with external profile of grip portion in a closed position around a tubular bar.

Referring to FIG. 1 through FIG. 7, mitt 10 consists of a hollow flexible body 12 having an interior 14, an exterior 16, a sleeve portion 18 and a grip portion 20 positioned at a remote end 22 of sleeve portion 18. Interior 16 of grip portion 20 is accessible by extending one's hand through sleeve portion 18. Grip portion 20 has an external profile 24 that is oriented transversely relative to sleeve portion 18. External profile 24 defines two extremities 26 and 28 which are movable between an open position best illustrated in FIG. 8 and a closed position best illustrated in FIG. 9. Referring to FIG. 8, in the open position extremities 26 and 28 are spaced apart to define an elongated "C" channel, generally indicated by reference numeral 30. Referring to FIG. 9, in the closed position extremities 26 and 28 are brought together to define an elongated tubular channel, generally indicated by reference numeral 32. Referring to FIG. 1 through FIG. 7, fasteners 34 and 36 are provided on extremities 26 and 28, respectively of grip portion 20 to selectively maintain grip portion 20 in the closed position with grip portion 20 closed around a tubular bar 100. The form of fasteners 34 and 36 illustrated are two components tape fasteners commercially sold under the Trademark VELCRO. It will be appreciated that other forms of fasteners may be used that can serve the same form of function, such as snaps or zippers.

Optionally, an anchor strap 38 may be provided with a fixed end 40 and a detachable end 42. Fixed end 40 is secured to body 12 at a fixed location.

Optionally, a pouch 44 may be provided in body 12. Pouch 44 is designed to receive a chemical hot pack that will heat body 12 of mitt 10.

Operation

Referring to FIG. 8, external profile 24 is placed in the open position and grip portion 20 of mitt 10 is placed over a tubular bar 100. Referring to FIG. 9, external profile 24 is then moved to the closed position and fasteners 34 and 36 secured to maintain external profile 24 of grip portion 20 in the dosed position. When the wearer removes his or her hands from mitt 10 to take a golf shot or check on an infant in an infant stroller, grip portion 20 remains in the closed portion closed around tubular bar 100. This is very convenient as it leaves mitt 10 suspended from tubular bar 100, ready for use when the user's task is completed.

If tubular bar 100 is supported at only one end, as is the case with some brands of golf cart, something more is required to keep grip portion 20 of mitt 10 from sliding off of tubular bar 100. In such applications, anchor strap 38 wraps around a vertical support 102 to which tubular bar 100 is attached to prevent grip portion 20 of body 12 from sliding relative to a longitudinal axis of tubular bar 100. Detachable end 42 of anchor strap 38 is sandwiched between fasteners 34 and 36. When an operator uses two mitts, detachable end 42 of anchor strap 38 is sandwiched between fasteners 34 and 36 of the opposite mitt. This results in anchor straps 38 assuming an "X" shape configuration. This is not an essential feature, but is useful to prevent the mitts from moving apart on tubular bar 100.

If the weather is cold enough that additional heat is desired, a chemical hot pack (not shown) may be inserted into pouch 44 to provide heat to body 12 of mitt 10.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A mitt comprising:

a hollow flexible body having an interior, an exterior, a sleeve portion and a grip portion positioned at a remote end of the sleeve portion, the interior of the grip portion being accessible through the sleeve portion, the external profile of the grip portion oriented transversely relative to the sleeve portion, the external profile of the grip portion defining two extremities being movable between an open position in which the extremities are spaced apart to define an elongated "C" channel and a closed position in which the extremities are brought together to define an elongated tubular channel; and fasteners positioned on the exterior of the body on the two extremities of the grip portion to selectively maintain the grip portion in the closed position, whereby the grip portion may be closed around a tubular bar with the exterior of the body engaging the tubular bar while the hand is insulated from the tubular bar within the interior of the body.

2. A mitt comprising:

a hollow flexible body having an interior, an exterior, a sleeve portion and a grip portion positioned at a remote end of the sleeve portion, the interior of the grip portion being accessible through the sleeve portion, the external profile of the grip portion oriented transversely relative to the sleeve portion, the external profile of the grip portion defining two extremities being movable between an open position in which the extremities are spaced apart to define an elongated "C" channel and a closed position in which the extremities are brought together to define an elongated tubular channel; and fasteners positioned on the exterior of the body on the two extremities of the grip portion to selectively maintain the grip portion in the closed position so that the grip portion may be closed around a tubular bar; and an anchor strap is provided with a fixed end and a detachable end, the fixed end being secured to the body at a fixed location and the detachable end being detachably secured to the body at location that is spaced from the fixed location, such that the anchor strap is used to prevent movement of the body relative an axis of a the tubular bar.

3. The mitt as defined in claim 2, wherein the sleeve on the exterior of the body has a pouch, whereby a chemical hot pack is received to heat the body.

* * * * *